US011274271B2

(12) United States Patent
Zamboni et al.

(10) Patent No.: US 11,274,271 B2
(45) Date of Patent: Mar. 15, 2022

(54) METHOD AND SYSTEM FOR HAZARDOUS DRUG SURFACE CLEANING

(71) Applicant: The University of North Carolina at Chapel Hill, Chapel Hill, NC (US)

(72) Inventors: William Zamboni, Chapel Hill, NC (US); Tom O'Neill, Potomac, MD (US); Stephen Eckel, Chapel Hill, NC (US)

(73) Assignee: The University of North Carolina at Chapel Hill, Chapel Hill, NC (US)

( * ) Notice: Subject to any disclaimer, the term of this patent is extended or adjusted under 35 U.S.C. 154(b) by 0 days.

(21) Appl. No.: 16/839,883

(22) Filed: Apr. 3, 2020

(65) Prior Publication Data

US 2020/0248111 A1 Aug. 6, 2020

Related U.S. Application Data

(60) Continuation-in-part of application No. 15/002,570, filed on Jan. 21, 2016, now abandoned, which is a division of application No. 14/215,855, filed on Mar. 17, 2014, now abandoned.

(60) Provisional application No. 61/788,426, filed on Mar. 15, 2013.

(51) Int. Cl.

| | |
|---|---|
| ***B08B 1/00*** | (2006.01) |
| ***C11D 17/04*** | (2006.01) |
| ***C11D 7/26*** | (2006.01) |
| ***C11D 7/32*** | (2006.01) |
| ***C11D 7/50*** | (2006.01) |
| ***C11D 11/00*** | (2006.01) |

(52) U.S. Cl.

CPC ..... *C11D 17/049* (2013.01); *B08B 1/006* (2013.01); *C11D 7/261* (2013.01); *C11D 7/3209* (2013.01); *C11D 7/5022* (2013.01); *C11D 11/0041* (2013.01); *C11D 11/0064* (2013.01)

(58) Field of Classification Search

None

See application file for complete search history.

(56) References Cited

U.S. PATENT DOCUMENTS

| | | | | |
|---|---|---|---|---|
| 5,639,532 | A | 6/1997 | Wells | |
| 5,767,163 | A | 6/1998 | Kundsin | |
| 5,811,113 | A | 9/1998 | Dorr et al. | |
| 5,985,302 | A | 11/1999 | Dorr et al. | |
| 2002/0103098 | A1 | 8/2002 | Harrison et al. | |
| 2006/0166849 | A1 | 7/2006 | Kilkenny | |
| 2006/0171765 | A1 | 8/2006 | Schwarz et al. | |
| 2007/0179079 | A1 | 8/2007 | Kilkenny | |
| 2007/0283514 | A1 | 12/2007 | Burgwin | |
| 2010/0179368 | A1 | 7/2010 | Conrad | |
| 2011/0038916 | A1 | 2/2011 | Buchalter | |
| 2012/0034287 | A1 | 2/2012 | Napolitano et al. | |
| 2013/0273133 | A1* | 10/2013 | Eddy | A01N 33/12 424/411 |

OTHER PUBLICATIONS

Kane Deborah M, "Evaluation of a Sanitizing System Using Isopropyl Alcohol Quaternary Ammonium Formula and Carbon Dioxide for Dry-Processing Environments", A Thesis submitted in partial fulfillment of the requirements for the degree Master of Science, 2012, Kansas State University, Manhattan, Kansas, US.

HDClean 1 Material Safety Data Sheet, Datasheet (online), ChemoGLO, LLC, Nov. 28, 2012. Retrieved on Jul. 31, 2014, Retrieved from the Internet <http://chemoglo.com/HD%20Clean%20MSDS%201%20QA.pdf>.

HDClean Hazardous Drug Clean. Datasheet (online), ChemoGLO, LLC, Jan. 2013. Retrieved on Jul. 31, 2014, Retrieved from the Internet <http://www.chemoglo.com/HDCleanTestResults.pdf> p. 1, line 1-2, lines 9-11, p. 1, lines 21-23, p. 2, lines 31-33.

HDClean 2 Material Safety Data Sheet, Datasheet (online), ChemoGLO LLC, Nov. 28, 2012. Retrieved on Jul. 31, 2014, Retrieved from the internet <http://www.chemoglo.com/HD%20Clean%20MSDS%202%20IPA.pdf>.

Search Report and Written Opinion Corresponding PCT Application No. 2014/28008, dated Jul. 24, 2014.

"Definition of Clean." Merriam Webster, www.merriam-webster.com/dictionary/clean. Accessed Aug. 10, 2017.

"Definition of Disinfect." Merriam Webster, www.merriam-webster.com/dictionary/disinfect. Accessed Aug. 10, 2017.

Tkaczuk et al., "Surface Contamination of Cytotoxic Drug 5-Fluorouracil (5FU) and Decontamination," Journal of Health, Safety and Environment, 2010, 26(2), 171-181.

* cited by examiner

*Primary Examiner* — Lorna M Douyon

(74) *Attorney, Agent, or Firm* — James G. Passe; Passe Intellectual Property, LLC

(57) ABSTRACT

The present invention relates to a method, a system, and a kit of parts for cleaning a surface contaminated with a hazardous drug or a hazardous drug related product, which involves cleaning in succession with a quaternary ammonium solution followed by an isopropyl alcohol solution.

5 Claims, No Drawings

METHOD AND SYSTEM FOR HAZARDOUS DRUG SURFACE CLEANING

This application is a continuation-in-part application of U.S. non-provisional application Ser. No. 15/002,570 filed on Jan. 21, 2016, now abandoned, which is a divisional of U.S. application Ser. No. 14/215,855 filed on Mar. 17, 2014, now abandoned, which claims the benefit of and priority to U.S. provisional application No. 61/788,426 filed on Mar. 15, 2013. All applications are incorporated herein in their entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a method and system for cleaning surfaces. More particularly, the present invention relates to a method and system for the removal of hazardous drug products from surfaces.

Description of Related Art

The ability to clean environmental surfaces of contamination is an important job in many situations from food preparation to hazardous situations. Each situation has various particular issues for contamination removal and the systems for cleaning vary with the contamination to be removed.

Most surface cleaning methods in the workplace and in other environments work to disinfect the surface in order to remove viral and bacterial contamination under conditions where the contamination will harm the individual in the environment or something prepared or worked on in the environment, like food preparation or the like. Disinfection concentrates on killing the virus or bacteria and not on cleaning, though removal of the contamination is a form of cleaning. Dead bacteria left behind do not usually pose much of a threat, if any. One of the most difficult areas of contamination to clean is in areas where drugs and related hazardous drug products are utilized. In these situations, the issue is not killing bacteria or viruses, it is the complete removal of products that even minute quantities might cause severe toxicities, injury, or even death to the subject or individual exposed to the contamination.

Since hazardous drugs are toxic, direct bodily contact thereto, or exposure to even micro-quantities of the drug, considerably increases the risk of developing health fatalities such as skin cancer, leukemia, liver damage, malformation, miscarriage, and premature birth. Such exposure can take place when a drug containing receptacle, such as a vial, bottle, syringe, and intravenous bag, is subjected to overpressure, resulting in the leakage of fluid or air contamination by the hazardous drug into the surroundings, Exposure to a hazardous drug also results from a drug solution remaining on a needle tip, on a vial or intravenous bag seal, or by the accidental puncturing of the skin by the needle tip. In addition, surface contamination can result from the synthesis, production, packaging, weighing, compounding of hazardous drugs, and the like. This is especially true for those working in healthcare situations or laboratories.

BRIEF SUMMARY OF THE INVENTION

The present invention relates to the discovery that a two part cleaning system cleans up hazardous drug surface contamination better than existing cleaning systems and methods. By cleaning first with a quaternary ammonium solution, followed in successive order by a isopropyl alcohol and water solution, hazardous drug products are cleaned up without leaving detectable residues on the surfaces.

In one embodiment, the present invention relates to a method of cleaning a surface contaminated with a hazardous drug or a hazardous drug related product comprising:

a) wiping the surface a first time with a first solution of an quaternary ammonium solution having a concentration of from about 0.01% to about 5%; and b) wiping the surface a second time in succession with a second solution of water and isopropyl alcohol, the isopropyl alcohol comprising at least about 50% of the solution.

In another embodiment, it relates to a system for cleaning a surface contaminated with a hazardous drug or a hazardous drug related product comprising a first towelette impregnated with a solution of a quaternary ammonium solution having a concentration of from about 0.01% to about 5%, and a second towelette impregnated with a water and isopropyl alcohol solution, the isopropyl alcohol comprising at least about 50% of the solution.

In yet another embodiment, it relates to a kit of parts for cleaning a surface contaminated with a hazardous drug or a hazardous drug related product comprising:

a) a first solution of an quaternary ammonium solution having a concentration of from about 0.01% to about 5%;

b) a second solution of water and isopropyl alcohol, the isopropyl alcohol comprising at least about 50% of the solution; and c) instructions for cleaning the contaminated surface with each of the solutions in succession.

DETAILED DESCRIPTION OF THE INVENTION

While this invention is susceptible to embodiment in many different forms, there will herein be described in detail specific embodiments, with the understanding that the present disclosure of such embodiments is to be considered as an example of the principles and not intended to limit the invention to the specific embodiments shown and described. This detailed description defines the meaning of the terms used herein and specifically describes embodiments in order for those skilled in the art to practice the invention.

DEFINITIONS

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, the term "cleaning" refers to the removal of contamination on a selected surface. In particular, it relates to the removal of hazardous drugs and hazardous drug related product (e.g., breakdown products and products used to make the hazardous drug) from the surface. In general, removal relates to removal of such contaminants to a degree that all detectable residues of a hazardous drug or hazardous drug related product are removed. Surfaces include, but are not limited to, countertops, equipment, walls, floors, and essentially any solid surface that is compatible with the ingredients being used to clean the surface.

As used herein, the term "surface" refers to any solid surface that one would encounter hazardous drug contamination. For example, in drug manufacturing, drug discovery and drug dispensing, counters, walls, equipment, cabinets, and the like in the environment may need to be cleaned of drug contamination. This is especially true where Federal Regulation dictates certain levels of cleanliness to operate a business.

The term "towelette", as used herein, generally includes any napkin, paper towel, tissue, fabric, doth, or similar material, or any other object suitable for applying the solutions of the present invention to the surface to be cleaned. The towelette can be reusable or disposable, as desired. A disposable towelette usually refers to low cost materials designed for a single use, such as those made with paper or very inexpensive cloth or other materials, since all materials can be disposed of. The material must be absorbent enough to impregnate the towelette with each of the solutions. Therefore, the material for each solution can be the same or can be different depending on the characteristics desired. Since it is intended for clean-up of a hazardous drug or a hazardous drug related product, it will need to be capable of having the product stuck or be absorbed in a slurry or solution on the surface of the towelette before disposal. The size of the towelette is, by choice, the size useful for the area to be cleaned in, and therefore is within the skill in the art if the towelette is small or large in view of the disclosure herein.

Medical, nursing, pharmacy, and laboratory personnel that are involved in the preparation, use, and administration of hazardous drugs suffer the risk of being exposed to the drugs or the compositions used in the manufacture and delivery of drugs, which may escape to the surrounding surfaces and thus come into contact with individuals utilizing the surfaces or coming into contact with them. As used herein, a "hazardous drug related product" is any material that coming into contact with, may constitute a health hazard. This includes the drugs themselves, the precursors, side products, solvents utilized therewith, and the like connected with the drugs themselves. Illustrative and non-limitative examples of such drugs include inter alia, cytotoxins, antiviral drugs, chemotherapy drugs, antibiotics, and radiopharmaceuticals, such as herceptin, cisplatin, fluorouracil, leucovorin, taxol, methotrexate, gemzar, cyclophosphamide, Cytoxan, and neosar, or a combination thereof, in a liquid or solid state. Other examples of hazardous drug products include docetaxel, paclitaxel, 5-fluorouracil, cyclophosphamide, ifosfamide, and cisplatin.

As used herein, the term "contaminated" refers to the hazardous drug or drug related product being on a surface where an individual can come into contact with the drug or drug related product.

The system comprises a first cleaning and a second cleaning. In this system, a process whereby the surface is first cleaned with a solution of a quaternary ammonium solution having a concentration of from about 0.01% to about 5%. In other embodiments, a reusable or disposable towelette can be impregnated with the solution. Next, after the first cleaning, a second cleaning in succession is performed.

As used herein, the term "in succession" refers to a time period right after the first cleaning, such that there is little or no time for the surface to be re-contaminated, such as mere seconds, but within a reasonable time period. The second cleaning is performed with a second solution of water and isopropyl alcohol, the isopropyl alcohol comprising at least about 50% of the solution. The towelettes or whatever is utilized to apply the solutions can be disposed of in hazardous waste containers or the like, or reutilized after appropriate cleaning. The solutions can be delivered for application by a user to a towelette or can be impregnated onto a towelette for use.

In one embodiment, there is a kit of parts wherein the first and second solution are packaged or otherwise delivered, along with instructions for use in cleaning a hazardous drug or hazardous drug related product from a surface by utilizing a first wiping and a second wiping with each of the solutions in succession.

EXAMPLE 1

Isopropyl alcohol (IPA) alone (50% solution) was used to clean a hazardous drug off of a surface. The result was that a significant drug residue still existed, so it was determined that IPA alone is not effective for cleaning a hazardous drug or a hazardous drug related product on a surface.

EXAMPLE 2

A mixture of comprising at least 0.08% Quaternary Ammonium (QA) and comprising at least 50% IPA were mixed together as a solution and used to clean a hazardous drug or a hazardous drug related product. The spray removed some, but was not effective in removing the entire hazardous drug indicating that the choice of towelette substrate material is materially important to the efficacy of the invention.

EXAMPLE 3

IPA towelettes have comprising at least 50% IPA and towelettes comprising at least 0.08% QA were prepared. Two hazardous drugs were placed on a surface and were cleaned by using the towelettes in sequence. In a first case, an IPA towelette was used first, followed by cleaning with the QA towelette. In a second case, the QA towelette was used first, followed by cleaning with the IPA towelette. The results were that there was still drug residue with the first case and no drug residue with the second case. The second case cleaning regime was the only cleaning strategy to completely clean the surface.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description. Consequently, while the present invention has been described with reference to particular embodiments, modifications of structure, sequence, materials, and the like apparent to those skilled in the art still fall within the scope of the invention as claimed by the applicant.

What is claimed is:

1. A method of cleaning a surface contaminated with a hazardous drug or a hazardous drug related product consisting of:

a) wiping the surface a first time with a first solution of quaternary ammonium solution having a concentration of from about 0.5% to about 5.0% by weight; and b) wiping the surface a second time in succession with a second solution of water and isopropyl alcohol, the isopropyl alcohol comprising about 50% by weight of the solution, wherein all detectable residues of the hazardous drug or the hazardous drug related product are removed from the surface.

2. The method according to claim 1 wherein each of the first solution and second solution are impregnated into a towelette.

3. The method according to claim 2 wherein the towelette is disposable.

4. The method according to claim 1 wherein the hazardous drug related product is at least one of docetaxel, paclitaxel, 5-fluorouracil, cyclophosphamide, ifosfamide and cisplatin.

5. The method according to claim 1 wherein the hazardous drug related product is at least one of herceptin, cisplatin, fluorouracil, leucovorin, taxol, methotrexate, gemzar, cyclophosphamide, Cytoxan, and neosar.

* * * * *